United States Patent [19]

Peruzzi

[11] Patent Number: 4,481,864

[45] Date of Patent: Nov. 13, 1984

[54] HYDRAULIC JACK WITH MECHANICAL SAFETY LOCK

[75] Inventor: Armando Peruzzi, Rome, Italy

[73] Assignee: Selenia Industrie Elettroniche Associate S.p.A., Rome, Italy

[21] Appl. No.: 400,159

[22] Filed: Jul. 20, 1982

[30] Foreign Application Priority Data

Jul. 21, 1981 [IT] Italy ..... 48943 A/81

[51] Int. Cl.[3] ..... F15B 15/26

[52] U.S. Cl. ..... 91/44; 91/45; 92/17; 92/21 MR; 92/24; 92/32; 92/33; 188/82.34; 188/82.8; 188/82.2

[58] Field of Search ..... 92/17, 32, 33, 21 R, 92/21 MR, 24, 27, 28, 31; 188/82.34, 82.3, 82.8, 82.2; 91/44, 45; 192/3 N

[56] References Cited

U.S. PATENT DOCUMENTS

| | | | |
|---|---|---|---|
| 1,740,692 | 12/1979 | Hall | 92/33 |
| 2,688,227 | 9/1954 | Geyer | 92/33 |
| 2,898,888 | 8/1959 | Geyer | 92/33 |
| 2,955,579 | 10/1960 | Block | 92/33 |
| 3,104,593 | 9/1963 | Clifton et al. | 92/21 MR |
| 3,603,212 | 9/1971 | Geyer | 92/33 |
| 3,955,658 | 5/1976 | Bustmante | 188/82.3 |
| 4,256,355 | 3/1981 | Yamaguchi et al. | 188/82.2 |

*Primary Examiner*—Robert E. Garrett
*Assistant Examiner*—Richard S. Meyer
*Attorney, Agent, or Firm*—Karl F. Ross

[57] ABSTRACT

A double-acting hydraulic jack, comprising a hollow piston reciprocable in a surrounding cylinder, includes a tubular shaft extending axially inside and carrying a nut of the circulating-ball type which coacts with a screw coaxially disposed in that shaft. The screw is rigid with the piston whereby an axial displacement of the latter is translated into a rotation of the shaft; a toothed wheel on the shaft, engaged by a spring-loaded detent, acts as a one-way brake enabling such rotation only in one direction and blocking it in the opposite direction unless the detent is withdrawn by a hydraulic servomotor which is pressurized concurrently with the admission of fluid to the cylinder tending to displace the piston in the normally blocked direction. In the case of a double-acting jack, two oppositely effective one-way brakes—possibly including a single toothed wheel on the tubular shaft—normally prevent a displacement in either direction but are respectively deactivated by the admission of fluid into the cylinder at one or the other end thereof.

SUMP
DISTRIBUTOR
P

HYDRAULIC JACK WITH MECHANICAL SAFETY LOCK

FIELD OF THE INVENTION

My present invention relates to a hydraulic jack of the double-acting type wherein a piston is axially reciprocable in a surrounding cylinder having two ports through which hydraulic fluid under pressure—referred to hereinafter as oil—can be selectively admitted.

BACKGROUND OF THE INVENTION

A jack of this type can be used, for example, for the erection of an initially horizontal load into a more or less vertical position, as described in my commonly owned copending application Ser. No. 334,460 filed Dec. 28, 1981. If the load is to be maintained for an extended period in its erected position, it must be sustained by the jack after the oil supply has been cut off. The oil trapped inside the cylinder will prevent any untimely descent of the load only as long as there is no leakage. If the risk of such leakage cannot be excluded, a backsliding of the jack must be resisted by mechanical locking means.

Such locking means have heretofore taken the form of screws axially threaded into the cylinder for backstopping the piston in the position last reached. This operation is tedious and time-consuming, as is the subsequent unthreading of the screws when the jack is to be restored to its normal position. There is also the danger of human error which may overstrain the hydraulic system if an operator causes oil to pressurize the piston in the reverse direction before withdrawing the backstopping screws.

The problem is particularly severe when, as described in my copending application referred to above, the load must sometimes be moved past its position of unstable equilibrium so that the double-acting piston is to be mechanically locked against untimely forward as well as reverse displacement.

The delay involved in emplacing and removing such mechanical stops is costly in industrial applications and may be particularly harmful in military installations, as where the load to be erected is a missile; see, for example, commonly owned U.S. application Ser. No. 342,392 filed Jan. 25, 1982 by Antonio Tripoli et al, now U.S. Pat. No. 4,415,304.

OBJECTS OF THE INVENTION

The general object of my present invention, therefore, is to provide means in such a jack for virtually eliminating the down-times heretofore required for mechanical locking and unlocking.

A related object is to provide simple but dependable means for automatically backstopping the piston of such a jack in any position into which it has been hydraulically shifted and for just as automatically releasing the backstop upon the application of reverse hydraulic pressure.

It is also an object of my invention to provide means in such a jack for enabling a controlled manual displacement of its piston in the event of failure of the hydraulic system.

SUMMARY OF THE INVENTION

A cylinder of a hydraulic jack according to my present invention has a hollow piston coaxially and nonrotatably disposed therein for displacement in a first and a second axial direction by hydraulic fluid (oil) admitted to a first or to a second port, respectively, on opposite sides of its piston head. A shaft journaled in the cylinder for rotation about its axis is connected with the piston by coupling means translating an axial displacement of the piston into a rotation of the shaft in a direction which depends on the direction of the axial shift. Rotation of the shaft in a direction corresponding to a piston shift in the second axial direction (usually the direction of retraction or collapse of the jack) is normally blocked by one-way brake means on the shaft provided with detent means which can be deactivated by release means responsive to the admission of oil to the second port.

Pursuant to a more particular feature of my invention, the shaft is tubular and accommodates a screw rigid with the piston, this screw forming part of the one-way brake means and extending axially into the shaft while being engaged by a nut secured to the shaft. The screw and the nut constitute a low-friction thread coupling which preferably is of the circulating-ball type and which may also enable a manual rotation of the shaft to displace the piston in the absence of oil pressure for extending or retracting the jack.

A further part of the one-way brake means, according to still another feature of my invention, comprises a toothed wheel on the shaft, the detent means comprising a spring-loaded element normally engaging between teeth of that wheel. The release means may be constituted in that case by a hydraulic servomotor having a fluid inlet in parallel with the second port of the cylinder, a mobile member of that servomotor being linked with the spring-loaded element for withdrawing same from the wheel in response to fluid pressure at this second port.

While the toothed wheel and the spring-loaded element could simply be a ratchet and a pawl, I prefer to provide the teeth of that wheel with symmetrically sloping flanks and to design the spring-loaded element as a bifurcate extremity of the mobile member of the hydraulic servomotor. This extremity is provided with guide slots in which a resiliently biased pin parallel to the common axis of the wheel, the shaft and the piston is slidable in a direction substantially tangential to the wheel periphery for enabling free rotation of the shaft in a direction corresponding to a piston shift in the first axial direction (usually the direction of extension of the jack). Such an arrangement has the advantage that another hydraulic servomotor may carry a similar pin in a pair of oppositely inclined slots for normally blocking the wheel also in the last-mentioned direction of rotation; an inlet of the latter servomotor, disposed in parallel with the first port of the cylinder, enables the withdrawal of that pin under hydraulic pressure designed to shift the piston in its first axial direction. This will lock the jack against untimely extension and retraction as long as no hydraulic pressure is applied to its cylinder.

If backstopping is needed in only one direction, as where the load to be erected does not transcend its position of unstable equilibrium, the teeth engageable by a hydraulically withdrawable spring-loaded element could be part of an outer ring of a convention freewheel whose inner ring, coupled with that outer ring through an overrunning clutch, is keyed to the shaft.

BRIEF DESCRIPTION OF THE DRAWING

The above and other features of my invention will now be described in detail with reference to the accompanying drawing in which.

SPECIFIC DESCRIPTION

Figures 1, 2:
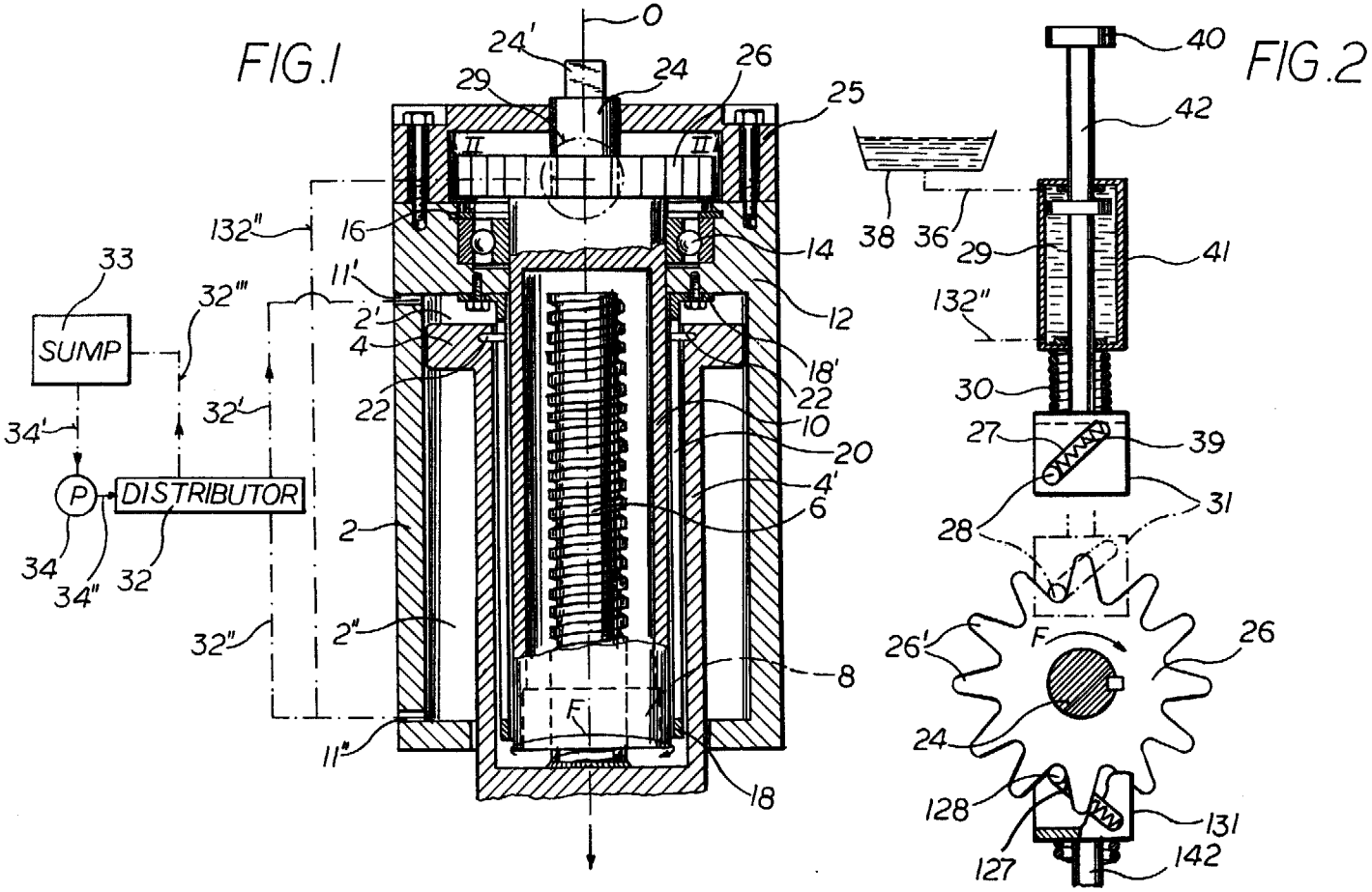
FIG. 1 is an axial sectional view of a representative portion of a hydraulic jack embodying my invention, this view also showing diagrammatically an associated hydraulic circuit.
FIG. 2 is a bottom view, taken on the line II—II of FIG. 1, of part of a releasable locking device included in my improved jack.

The jack shown in FIG. 1 comprises a cylinder 2 centered on an axis O, assumed to be substantially vertical. A piston axially slidable in cylinder 2 has a piston head 4 and a hollow stem 4' terminating at its lower end in a suitable anchor member such as an eye lug 56 shown in FIG. 3. The bottom of the cylindrical cavity of piston stem 4' fixedly supports a screw 6 with right-handed threads rising axially into that cavity over a length at least equal to that of the piston stroke. A nut 8 surrounding the screw 6 is rigid with the lower end of a tubular shaft 10 spacedly surrounding the screw 6 inside the piston stem 4'. The top of shaft 10 is rotatably journaled in a bore of a horizontal end wall 12 of cylinder 2 by a ball bearing 14 holding the shaft in an axially fixed position, the outer race of the bearing being kept in place by a split steel ring 16 snapped into an inner peripheral groove of the aforementioned bore. The threads of screws 6 are engaged inside nut 8 by captive balls 6' circulating in a track therefor as is well known in the art and has been particularly illustrated in FIG. 3.

Piston 4, 4' is held against rotation relative to cylinder 2 by a tube 18 which is inserted into the annular clearance between stem 4' and shaft 10, this tube having a flange 18' fastened to cylinder wall 12 and further having two diametrically opposite longitudinal slots 20 which are traversed by pins 22 projecting inward from piston head 4. The lengths of slots 20, of course, is sufficient to let the piston execute its full stroke inside the cylinder.

The top of shaft 10 is reduced to form a stud 24 which is rotatable in a housing 25 that is secured to cylinder 2 as an upward extension thereof. Keyed to stud 24 is a toothed wheel 26 having peripheral teeth 26' with symmetrically sloping flanks as illustrated in FIG. 2. A hydraulic servomotor 29, whose position is diagrammatically indicated by a phantom outline in FIG. 1, comprises a cylinder 41 axially traversed by a plunger 42 in a radial direction of the main cylinder 2, i.e. perpendicular to axis O. Plunger 42 terminates in a bifurcate extremity 31 which is urged by a strong coil spring 30 toward the wheel 26, i.e. into an advanced blocking position indicated in phantom lines in which the prongs of extremity 31 straddle some of the teeth 26'. These prongs are provided with parallel slots 27 for the guidance of reduced ends of a vertical locking pin 28 which is urged by a spring 39, much weaker than spring 30, toward the outer ends of these slots. The slots 27 form a guidepath inclined to the direction of thrust of spring 30 at an angle substantially corresponding to that of a line which is tangent to the root circle of teeth 26' at a point where pin 28 engages between these teeth in its illustrated phantom-line forward position. Since the inner ends of slots 27 lie outside the orbit of teeth 26' in the limiting advanced position of plunger 42, pin 28 can be repressed by an oncoming tooth 26' against the biasing force of spring 39 into its rearward position so as to let that tooth escape for a clockwise rotation of wheel 26 as viewed in FIG. 2, that sense of rotation being indicated by an arrow F. A rotation in the opposite sense, however, is prevented by the pin 28 so that the combination of wheel 26 with detent 28, 31 acts as a one-way brake comparable to that of a pawl-and-ratchet coupling.

The hydraulic system associated with the jack shown in FIG. 1 comprises a sump or reservoir 33 from which oil can be drawn by a pump 34 through a distributor 32, such as a solenoid valve, for admission to either an upper port 11' or a lower port 11" of cylinder 2 via respective lines 32' and 32". With distributor 32 in a position corresponding to an extension of the jack, oil flows in the direction of the arrows from pump 34 via line 32' and port 11' into an upper compartment 2' of cylinder 2 to depress the piston 4, 4' relatively to the cylinder; with the lower end of the piston anchored to a base, this motion will result in a rise of cylinder 2 and thus in an elevation of a load supported thereby through the intermediary of housing 25. Oil displaced from a lower compartment 2" of cylinder 2, underneath piston head 4, is returned to the sump 33 by way of port 11", line 32", distributor 32 and another line 32'''.

As will be apparent from FIG. 1, a downward displacement of piston 4, 4' with entrainment of screw 6 sets the nut 8 and thus the shaft 10 in rotation in the direction of arrow F, i.e. clockwise as viewed in FIG. 2. Thus, the elevation of the load by hydraulic pressure is not significantly resisted by the one-way brake so far described with reference to FIG. 2. With reverse rotation of wheel 26 blocked by the pin 28, no descent of the cylinder 2 relative to the piston 4, 4' is possible after the cutoff of the oil supply to port 11' (with distributor 32 in a neutral position) even if the nonillustrated hydraulic seals in the cylinder should permit oil to leak from compartment 2'.

When it is desired to retract the jack, a reversal of distributor 32 admits oil under pressure by way of line 32" into port 11" and thus into cylinder compartment 2". A branch 132" of line 32" extends to an inlet of servocylinder 41 (FIG. 2) whereby oil under pressure also enters that cylinder to retract its plunger 42 against the force of spring 30, thereby withdrawing the pin 28 from its blocking position into an unblocking position as shown in full lines in FIG. 2. With the detent thus deactivated, wheel 26 is free to rotate counterclockwise (against the direction of arrow F) as viewed in this Figure whereby piston 4, 4' can rise along with screw 6 to return the jack to its collapsed position represented in FIG. 1. Oil expelled from the far end of servocylinder 41 passes via a line 36 into an overlying receptacle 38 from which it re-enters that cylinder whenever the oil pressure in line 132" is relieved, i.e. not later than upon a subsequent re-extension of the jack by repressurization of cylinder compartment 2'. At that point, of course, spring 30 will cause a re-engagement of locking pin 28 with the teeth 26' of wheel 26; such re-engagement could, possibly, occur also upon prolonged standstill in the event of leakage of oil from servocylinder 41.

A handle 40 at the end of plunger 42 enables a manual deactivation of detent 28, 31 if, for example, a failure of the hydraulic system prevents a release in the aforedescribed manner. A square block 24' integral with stud 24, projecting from housing 25, facilitates manual rotation of shaft 10 with the aid of a suitable wrench when, for any reason, a hydraulic shift of piston 4, 4' is impossible or undesirable.

Figure 3:
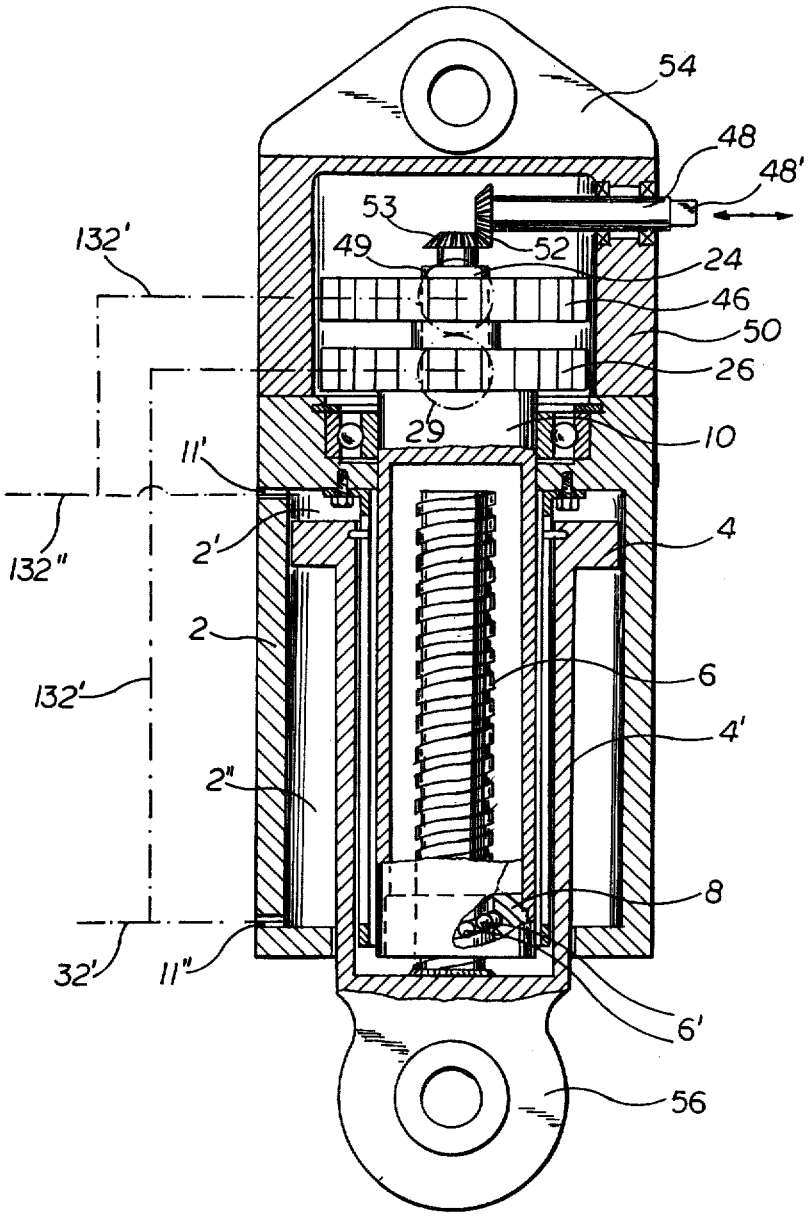
FIG. 3 is a view generally similar to that of FIG. 1, illustrating a modification.

In FIG. 3 I have shown a modified jack, generally similar to that of FIG. 1, in which the housing 25 has been replaced by a larger housing 50 terminating in another anchor lug 54. The jack of FIG. 3 is designed to be mechanically immobilized in both directions, as previously discussed, and for this purpose is provided with two toothed wheels 26, 46 keyed to its stud 24. The second wheel 46 coacts with a hydraulic servomotor 49, represented only by a phantom outline, which is identical with servomotor 29 as shown in FIG. 2 except that its guide slots 127 (cf. FIG. 2) are inclined at an opposite angle to the radial thrust direction so that its pin 128 blocks counterclockwise rotation of shaft 10 as viewed in FIG. 2. When the jack is to be extended, therefore, oil under pressure admitted by line 32' into port 11' is also fed via a branch 132' to the cylinder of servomotor 49 for withdrawing its locking pin from the wheel 46. The operation is otherwise analogous to that described above.

The two servomotors 29, 49 could also be used jointly on one and the same wheel 26, as illustrated in FIG. 2 where the locking pin 128 of the second servomotor is shown to be guided in slots 127 whose inclination is opposite that of slots 27. With the two-wheel arrangement of FIG. 3, however, toothed wheels 26 and 46 could be designed as the outer rings of a pair of freewheels with oppositely effective overrunning brakes, in which case the slotted bifurcations with their resiliently biased pins may be replaced by simpler detents such as suitably shaped tips of the respective plungers.

Since the top of shaft 10 is not accessible in the structure of FIG. 3, its stud 24 is coupled in that instance by a pair of bevel gears 52, 53 with an ancillary shaft 48 which passes radially through the peripheral wall of housing 50 and ends in a square block 48' engageable by a wrench or spanner. Such a coupling could, of course, also be used in the jack of FIG. 1 in lieu of the upwardly projecting block 24'.

The hydraulically releasable locking mechanism according to my invention, whether undirectionally or bidirectionally effective, operates in a highly dependable manner and is inexpensive to install.

I claim:

1. A hydraulic jack comprising:

a cylinder with first and second ports at opposite ends thereof selectively connectable by a distributor to a source of hydraulic fluid under pressure;

a hollow piston coaxially disposed in said cylinder with a piston head located between said ports for displacement in a first and a second axial direction by hydraulic fluid admitted to said first and said second port, respectively;

guide means in said cylinder preventing relative rotation of said piston;

a shaft journaled in said cylinder for rotation about the axis thereof;

coupling means connecting said piston with said shaft for translating an axial displacement of said piston into a rotation of said shaft in a sense depending upon the direction of said axial displacement;

a wheel on said shaft having teeth with sloping flanks;

a mobile member urged radially toward said shaft by a strong spring and provided with an extremity forming a guidepath which extends in a direction substantially tangential to the periphery of said wheel in an advanced position of said member;

a pin on said extremity parallel to said shaft and movable along said guidepath between a forward position lying between teeth of said wheel and a rearward position withdrawn from the orbit of said teeth, said pin being urged into said forward position by a weak spring for enabling rotation of said wheel and said shaft against the force of said weak spring in a sense corresponding to said first axial direction while blocking rotation thereof in the opposite sense corresponding to said second axial direction; and 'a hydraulic servomotor provided with a fluid inlet in parallel with said second port for retracting said mobile member from said advanced position against the force of said strong spring to facilitate a displacement of said piston in said second axial direction.

2. A hydraulic jack comprising:

a cylinder with first and second ports at opposite ends thereof selectively connectable by a distributor to a source of hydraulic fluid under pressure;

a hollow piston coaxially disposed in said cylinder with a piston head located between said ports for displacement in a first and a second axial direction by hydraulic fluid admitted to said first and said second port, respectively;

guide means in said cylinder preventing relative rotation of said piston;

a shaft journaled in said cylinder for rotation about the axis thereof;

coupling means connecting said piston with said shaft for translating an axial displacement of said piston into a rotation of said shaft in a sense depending upon the direction of said axial displacement;

wheel means on said shaft having teeth with sloping flanks;

a first mobile member urged in a first radial direction toward said shaft by a first strong spring and provided with a first extremity forming a first guidepath which extends at an acute angle to said first radial direction in an advanced position of said first member;

a first pin on said first extremity parallel to said shaft and movable along said first guidepath between a forward position lying between teeth of said wheel means and a rearward position withdrawn from the orbit of said teeth, said first pin being urged into said forward position thereof by a first weak spring for enabling rotation of said wheel means and said shaft against the force of said first weak spring in a sense corresponding to said first axial direction while blocking rotation thereof in the opposite sense corresponding to said second axial direction;

a second mobile member urged in a second radial direction toward said shaft by a second strong spring and provided with a second extremity forming a second guidepath which extends at an acute angle to said second radial direction in an advanced position of said second member;

a second pin on said second extremity parallel to said shaft and movable along said second guidepath between a forward position lying between teeth of said wheel means and a rearward position withdrawn from the orbit of said teeth, said second pin being urged into said forward position thereof by a second weak spring for enabling rotation of said wheel means and said shaft against the force of said second weak spring in a sense corresponding to said second axial direction while blocking rotation thereof in the opposite sense corresponding to said first axial direction;

a first hydraulic servomotor provided with a fluid inlet in parallel with said second port for retracting said first mobile member from said advanced position thereof against the force of said first strong spring to facilitate a displacement of said piston in said second axial direction; and a second hydraulic servomotor provided with a fluid inlet in parallel with said first port for retracting said second mobile member from said advanced position thereof against the force of said second strong spring to facilitate a displacement of said piston in said first axial direction.

3. A jack as defined in claim 1 wherein said extremity is bifurcate with sprongs straddling the teeth of said wheel.

4. A jack as defined in claim 2 wherein each of said first and second extensions is bifurcate with prongs straddling the teeth of said wheel means.

5. A jack as defined in claim 2 or 4 wherein said wheel means comprises a single wheel whose teeth have flanks of symmetrical slope.

6. A jack as defined in claim 1 or 2 wherein said shaft is tubular, said coupling means comprising a screw rigid with said piston extending axially into said shaft and a nut engaged by said screw secured to said shaft.

7. A jack as defined in claim 6 wherein said nut forms a track for the circulation of captive balls.

8. A jack as defined in claim 1 or 2, further comprising operating means for manually rotating said tubular shaft to displace said piston in the absence of fluid pressure.

9. A jack as defined in claim 8, further comprising manually operable unblocking means for deactivating said detent means in the absence of fluid pressure.

* * * * *